United States Patent [19]

Matsumoto et al.

[11] 4,339,287

[45] Jul. 13, 1982

[54] PROCESS FOR PRODUCING GRAIN-ORIENTED SILICON STEEL STRIP

[75] Inventors: Fumio Matsumoto, Kitakyushu; Satohiro Hayami, Yokohama; Tsutomu Haratani, Kitakyushu; Kunihide Takashima; Toshio Kikuma, both of Fukuoka, all of Japan

[73] Assignee: Nippon Steel Corporation, Tokyo, Japan

[21] Appl. No.: 149,957

[22] Filed: May 15, 1980

[30] Foreign Application Priority Data

May 16, 1979 [JP] Japan ..... 54/60057

[51] Int. Cl.[3] ..... H01F 1/04

[52] U.S. Cl. ..... 148/111; 148/12 A

[58] Field of Search ..... 148/12 A, 110, 111, 148/112, 113, 120, 121, 122

[56] References Cited

U.S. PATENT DOCUMENTS

| | | | |
|---|---|---|---|
| 1,313,054 | 8/1919 | Berry | 148/12 A |
| 1,898,061 | 2/1933 | Otte | 148/111 |
| 2,234,968 | 3/1941 | Hayes et al. | 148/120 |
| 3,647,575 | 3/1972 | Fiedler et al. | 148/111 |
| 3,764,406 | 10/1973 | Littmann | 148/110 |
| 3,990,923 | 11/1976 | Takashina et al. | 148/112 |
| 4,108,694 | 8/1978 | Shiozaki et al. | 148/110 |

*Primary Examiner*—John P. Sheehan

*Attorney, Agent, or Firm*—Wenderoth, Lind & Ponack

[57] ABSTRACT

In a process for the production of a grain-oriented silicon steel strip, a slab is heated, hot-rolled, cold-rolled, and subjected to a decarburization annealing and secondary recrystallization annealing steps. Grain coarsening is likely to occur during the high temperature heating and remain in the final product as streaks. The secondary recrystallization is, therefore, incomplete due to the streaks. In the hot rolling, an asymmetric flow, is applied to the steel, so as to eliminate the streaks and, hence, to obtain excellent magnetic properties.

6 Claims, 11 Drawing Figures

20 cm 3 cm

| | | |
|---|---|---|
| $B_8$ (T) | 1.63 | 1.93 |
| $W_{17/50}$ (W/Kg) | — | 1.06 |

PROCESS FOR PRODUCING GRAIN-ORIENTED SILICON STEEL STRIP

The present invention relates to a process for producing a grain-oriented silicon steel strip or sheet, wherein the crystals of the steel strip or sheet have an orientation of {110} <001> and, further, the steel is easily magnetized in the rolling direction.

As is well known, in the production of a grain-oriented silicon steel strip or sheet, a silicon steel slab is hot rolled and is subjected to at least one cold rolling operation so as to reduce the thickness of the strip. At least one annealing operation is applied to the hot rolled strip or cold rolled strip, if necessary. The steel strip is then subjected to a decarburization annealing and a final high temperature annealing.

In the final high temperature annealing, crystal grains of the steel strip or sheet are caused to coarsely grow, so that the crystal grains have a {110} <001> orientation. Such crystal grain growth is referred to as a secondary recrystallization.

The so produced grain-oriented silicon steel strip or sheet has the axis of easy magnetization in the rolling direction and is used mostly for the core of a transformer. As the material for the core of a transformer the watt loss should be as low as possible, because thermal energy consumed in the core is high when the watt loss is high.

In order to provide the grain-oriented silicon steel strip or sheet with a low watt loss property, the crystal grains should have exclusively the {110} <001> orientation mentioned above and, thus, the magnetic flux density in the rolling direction of the steel strip or sheet should be high.

As is well known, inhibitors such as MnS and AlN, play an important role during the final annealing in the inhibition of the growth of matrix grains. It is crucial in the production of grain-oriented silicon steel strips or sheets to effectively control the solid-solution and precipitation of the inhibitor mentioned above. In order to perform such effective control, steel slabs are heated prior to hot rolling to a high temperature, for example 1300° C. or higher, so as to bring the components of the inhibitors, such as Al, N and S, satisfactorily into a solid solution, and; subsequently, the inhibitors are precipitated in the succeeding steps including the hot rolling. Since the slab heating temperature for a grain-oriented silicon steel is considerably higher than that of the low carbon steel grades, a coarsening of crystal grains is likely to occur during the heating.

Coarse crystal grains having a <110> orientation, which is parallel to the rolling direction, are elongated during the hot rolling in the rolling direction and remain in the hot rolled steel sheet as a so called streaks. However, the elongated crystal grains may not be satisfactorily broken up in the production steps subsequent to the hot rolling, with the result that the secondary recystallization in the final high temperature annealing becomes incomplete. Portions of the grain-oriented silicon steel strip or sheet, where the secondary recrystallization is incomplete, have the streaks mentioned above. When the slab heating temperature is lower than 1300° C., the inhibitors are not brought into solid solution satisfactorily, and therefore, the secondary recrystallization becomes incomplete, and fine grains appear on the entire surface of the strip or sheet.

In recent years, the conventional ingot making process has been replaced by the continuous casting process, in which a columnar structure is formed in the slab due to rapid cooling solidification, i.e. the peculiar solidification in continuous casting. When the slabs having the columnar structure are heated to a high temperature, an abnormal coarsening of grains is likely to occur, as compared with the slabs produced by the conventional ingot-making and slabbing processes, due to the columnar structure formation. Consequently, the streaks described hereinabove are caused to be formed due to the coarsening of grains.

It is an object of the present invention to provide a process for producing a grain-oriented silicon steel strip with excellent magnetic properties and without streaks, which process is capable of stabilizing the secondary recrystallization.

It is another object of the present invention to utilize the industrial advantage of the continuous casting process over the conventional ingot-making process, i.e. the elimination of a slabbling step, and to eliminate the inconvenience of the streak formation in the process for producing the grain-oriented silicon steel strip or sheet by the continuous casting process.

In accordance with the objects of the present invention, there is provided a process for producing a grain-oriented silicon steel strip or sheet, wherein a silicon steel slab obtained by a continuous casting process, and containing from 2.0 to 4.0% by weight of silicon, not more than 0.085% by weight of carbon as basic components, and further containing at least one inhibitor element is subjected to hot rolling followed by a hot coil annealing of the hot rolled strip, if necessary, and then by at least one cold rolling step, and the cold rolled steel strip is subjected to a decarburization annealing and a final high temperature annealing. The inhibitor component is selected from the group consisting of aluminum, nitrogen, manganese, sulfur, selenium, copper, antimony, and other known inhibitor components. During the hot rolling, which comprises at least one rough rolling step with a plurality of passes and a finish rolling step with a plurality of passes, the steel slab is subjected to at least one pass which generates a plastic flow, which is asymmetric in the upper and lower regions of the steel slab as seen in the cross section of the steel slab in the rolling direction, and due to the asymmetric plastic flow, the grain-oriented silicon steel strip exhibits no streaks.

The present invention is explained in detail hereinafter.

The starting material of the process according to the present invention contains from 2.0 to 4.0% by weight of silicon and not more than 0.085% of carbon, as well as an appropriate amount of commonly known components as inhibitors, such as aluminum, nitrogen, manganese and sulfur, selenium, and antimony. The remainder of the starting material is iron and unavoidable impurities. When the silicon content exceeds 4.0%, the cold rolling becomes disadvantageously difficult, while at the silicon content of less than 2.0%, such disadvantages as the deterioration of magnetic properties, particularly high watt loss, are caused by the low silicon content. It is well known in the art of grain-oriented silicon steel that the watt loss can be reduced by the increase of silicon content. However, the present inventors discovered that the secondary recrystallization becomes incomplete with the increase in the silicon content and, hence, the final products of required magnetic properties, cannot be obtained only by the increase in silicon content. In the steel strip containing 3% by weight or higher, preferably 3.5% by weight or higher of silicon, the secondary recrystallized grains can be completed due to the introduction in the hot rolling step of an asymmetric plastic flow. It is, therefore, possible to provide the grain-oriented silicon steel strip with a low watt loss which is decreased with the increases of silicon content up to 4.0%. When the carbon content exceeds 0.085%, it becomes difficult to reduce the carbon level in the decarburization annealing, which is undesirable. The carbon is required for preventing the grain growth during heating and is also required for promoting the breaking up of the coarse grains during the hot rolling. It has been conventionally preferred to contain approximately 0.06% of carbon in the seel at the time of steel making. If the carbon content is less than approximately 0.06%, streaks are likely to form in the final products produced by the conventional process.

In the process of the present invention, wherein the slab is subjected to the hot rolling with the asymmetric plastic flow, the defects of streaks are not formed when the carbon content is reduced from 0.06%, the amount which is necessary in the conventional process for preventing the streaks, to approximately 0.04%. The low carbon content facilitates the decarburization annealing and is advantageous from the industrial point of view because of the low heat energy for the decarburization. In addition to the reduction of carbon content and increase of silicon content without forming the streaks, the components of inhibitors, particularly aluminum, can be increased due to the asymmetric plastic flow. From the starting material of the process according to the present invention, it should be understood that the steel material containing the components mentioned above is prepared by known techniques of steel making, melting and continuous casting.

The starting material described above is heated to a temperature of 1300° C. or higher and, subsequently, hot-rolled into a hot rolled strip. The hot rolled strip is subjected, if necessary, to annealing at a temperature of 1200° C. or lower for a period of 30 seconds or shorter and, then, cold-rolled to the final thickness. The cold rolling is carried out in at least one step and may be followed by annealing. The combination of the annealing step and cold rolling step is conventionally carried out in the process for producing a grain oriented silicon steel strip. The steel strip having the final thickness is subjected to decarburization annealing followed by the final high temperature annealing. The condition of annealing between rolling steps is known from U.S. Pat. No. 3,636,579, issued to Sakakura et al. and assigned to Nippon Steel Corporation. The condition of decarburization annealing and final high temperature annealing is known from U.S. Pat. No. 3,990,923, issued to Takanashi et al. and assigned to Nippon Steel Corporation. The crux of the present invention resides in the slab-hot rolling process which generates the asymmetric plastic flow in a continuously cast slab. The slab is heated to a high temperature of above 1300° C. in a slab-heating furnace and, then, is taken out of the furnace. The slab is then hot rolled into a sheet-bar having a predetermined thickness in a rough rolling step having a plurality of passes, and the sheet-bar is rolled to a hot rolled steel strip having a predetermined thickness in a finish rolling step with a plurality of passes.

The hot rolling process and structure of the slab and hot rolling strip are explained hereinafter with reference to the drawings.

Figure 5A:
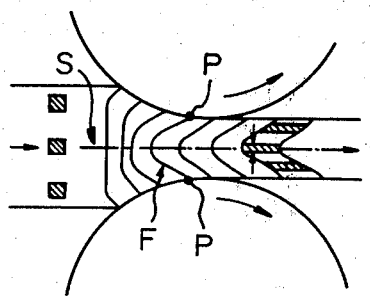
Figure 5B:
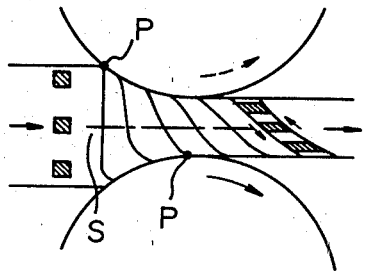

FIGS. 5A and 5B schematically illustrated differences in a plastic flow due to the difference in the hot rolling process.

Figure 6A:
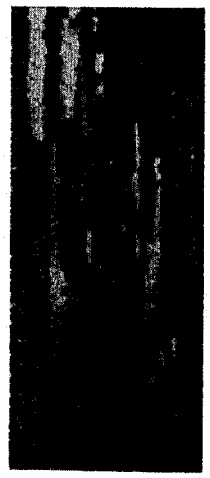
Figure 6B:
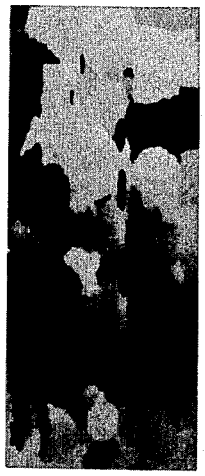

FIGS. 6A and 6B are photographs illustrating the structure of the final products, with the magnetic properties of each final product mentioned below its photograph.

Figure 1:
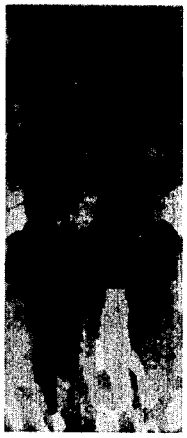
FIG. 1 is a photograph showing the crystal structure of a slab heated to an elevated temperature prior to hot rolling.
Figure 2A:
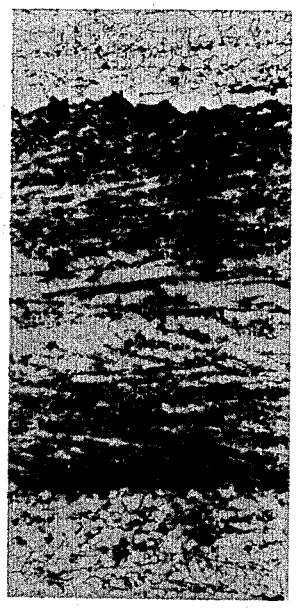
FIGS. 2A and 2B are photographs illustrating the structure of a cross section of the hot rolled strip.
Figure 3B:
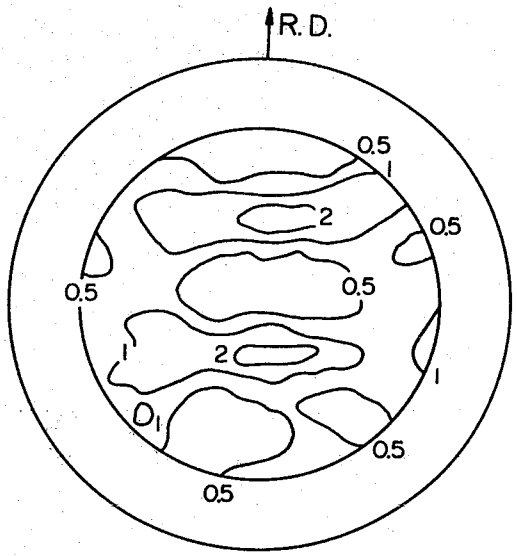
FIGS. 3A and 3B are (110) pole figures of the hot rolled sheet at a half thickness portion of the sheet and the sheet in FIGS. 3A and 3B corresponds to that illustrated in FIGS. 2A and 2B, respectively.
Figure 3A:
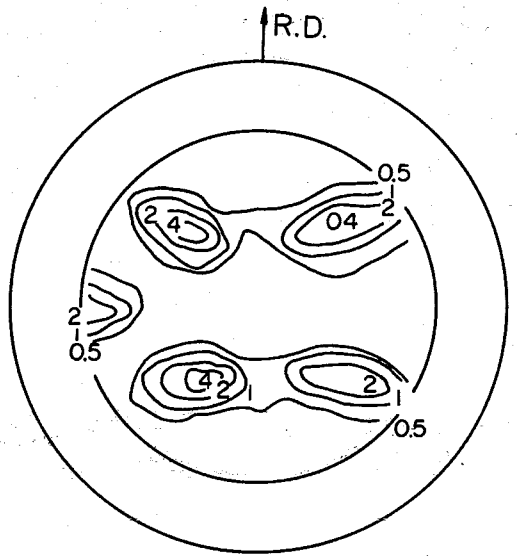
Figure 4A:
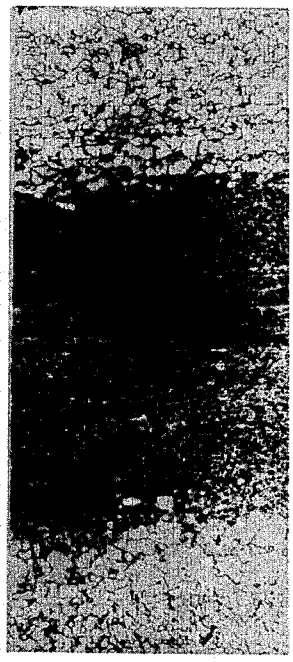
FIGS. 4A and 4B are photographs of the structure of a cross section of the annealed hot rolled strip.

Prior to the hot rolling, the slab is heated to a high temperature of 1300° C. or higher, so as to satisfactorily bring the inhibitors into solid solution. An abnormal grain-coarsening occurs, due to the high temperature slab heating. The rough rolling is usually carried out at a temperature higher than 1200° C. and the finish rolling is usually carried out at a temperature in the range of from 950° to 1250° C. The hot rolled strip produced by a conventional hot rolling process, in which symmetric plastic flow is generated, exhibits a structure as illustrated in FIG. 2A. The coarse grains tend to remain at a core of the strip and are elongated in the rolling direction. The elongated grains have a orientation of from {115} <110> to {114} <110> as will be understood from FIG. 3A. The texture having a <110> orientation in the rolling direction is not broken up by the hot coil annealing and remains in the hot rolled strip, as shown in FIG. 4A. The texture mentioned above is stable in the cold rolling and annealing subsequent to the hot rolling, and remains as streaks in the final product. As a result, the secondary recrystallization may be realized incompletely. Such incomplete secondary recrystallization leads to poor magnetic properties.

Figure 2B:
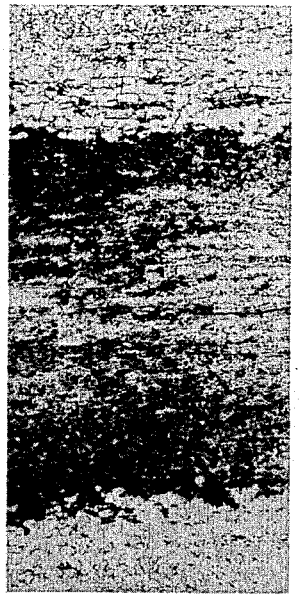

Shown in FIG. 2B is the structure of a hot rolled strip according to the present invention, generating the asymmetric plastic flow. The coarse elongated grains, which remain in the steel strip produced by conventional rolling process, are broken up at the core of the hot rolled strip according to the process of the present invention. The texture of this steel strip is dispersed as will be understood from FIG. 3B.

Figure 4B:
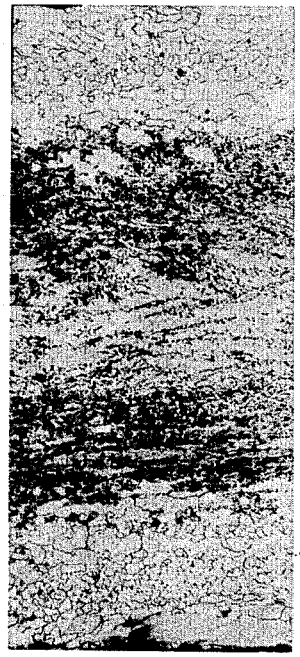

Shown in FIG. 4B is the structure of the annealed strip. As is apparent from FIG. 4B, the recrystallization is considerably developed at the core of the hot rolled strip, as compared with the core shown in FIG. 4A.

In the conventional hot rolling with a symmetric plastic flow, the neutral points P (FIG. 5A), where the relative speed between the work piece and roll is zero, are positioned at the symmetric points of the upper and lower rolls. In such hot rolling, the surface portions of the work piece are constrained by the rolls and a sliding deformation occurs at these surface portions, while in the core the work piece is not constrained by the rolls and a compression deformation occurs at this core. The deformation is symmetric, and the plastic flow is as illustrated by lines F in FIG. 5A. The coarse grains having a <110> orientation in the rolling direction are not broken up by this deformation and remain elongated in the rolling direction in the core of the hot rolled strip.

Contrary to the conventional hot rolling illustrated in FIG. 5A, in the present invention the neutral points P of the rolls are not coincident between the upper roll and lower rolls, as illustrated in FIG. 5B, and the plastic flow of the rolled material is asymmetric in the upper and lower regions of the rolled material, as seen in the cross section of the rolled material in the rolling direction. The shear stress constrained by the rolls is extended even to the interior of the work piece. The elongated coarse grains at the core of the steel strip are effectively broken up by the shear stress and no streaks are present in the final products. This is because, the broken up grains, which are formed by the asymmetric hot rolling process, have a small grain size, so that these small grains are eaten up or absorbed during the final high temperature annealing. Due to the breaking up of the elongated coarse grains, in addition to the elimination of the streaks, the number of crystal nuclei of Goss orientation, i.e. {100} <001> orientation, is increased and, therefore, the magnetic properties of the final products are enhanced.

The hot rolling with an asymmetric plastic flow is preferably carried out at the finish rolling step by several passes, but may be carried out at the rough rolling step. In order to achieve the hot rolling with the asymmetric plastic flow, the ratio of the circumferential velocities or the ratio of the diameters of the upper and lower work rolls can be chosen so that they are greater or smaller than 1.00.

The present invention will now be more fully explained by way of example.

EXAMPLE

A 40 mm thick slab, containing 0.04% by weight of carbon, 2.9% by weight of silicon, 0.03% by weight of aluminum, and a minor amount of manganese and sulfur, was heated to 1400° C., and then, hot rolled into 2.3 mm thick strips under two conditions. These hot rolling conditions were the same, except that the ratio of the circumferential speeds of the upper and lower work rolls was different, as mentioned in the following table.

| Hot Rolling Conditions | Ratio of Circumferential Speed of Work Rolls | Draft | | |
|---|---|---|---|---|
| | | First Pass | Second Pass | Third Pass |
| A (conventional) | 1.00 | 60% | 65% | 55% |
| B (invention) | 1.25 | 60% | 65% | 55% |

The structure and texture at the core of the hot rolled strips were as illustrated in FIGS. 2A, B and 3A, B, respectively. The hot rolled strips produced by the two conditions mentioned above were continuously annealed at 1120° C., followed by rapid cooling. The structure of the so annealed strips is illustrated in FIG. 4. The strips were then pickled, followed by cold-rolling to the thickness of 0.3 mm, and subsequently, decarburized at 850° C. and, then, subjected to a final secondary-recrystallization annealing at 1200° C., to obtain the final products.

The macrostructure and magnetic properties of the final products are illustrated in FIGS. 6A and B, respectively. The following facts will be apparent from FIGS. 2A, B through 6A, B.

In the final product using the hot rolled strip which is rolled according to the conventional conditions A mentioned in the table, above, streaks due to elongated coarse grains in the hot rolled strip are conspicuous. On the other hand, in the final product using the hot rolled strip which is rolled according to the condition B mentioned in the table, above, of the present invention, the secondary recrystallization is completed in the entire strip and the magnetic properties are excellent.

We claim:

1. A process for producing a grain-oriented silicon steel strip having [110] <001> orientation, consisting essentially of the steps of:
   - continuously casting a silicon steel slab;
   - heating said continuously cast silicon steel slab at a temperature of 1300° C. or higher, which slab contains from 2.0 to 4.0% by weight of silicon and not more than 0.085% by weight of carbon as basic components;
   - hot rolling said heated continuously cast silicon steel slab at a finishing temperature of from 950° to 1200° C., thereby obtaining a hot rolled strip;
   - subjecting the hot rolled strip to at least one cold rolling step;
   - subjecting the thus cold rolled strip to a decarburization annealing step; and,
   - subjecting the thus annealed sheet to a final high temperature annealing, wherein, during said hot rolling, the steel slab is subjected to at least one hot rolling pass at a temperature range of from 950° C. to 1250° C., said hot rolling being carried out with upper and lower rolls having circumferential speeds different from each other and which pass is sufficient to generate a plastic flow which is asymmetric in the upper and lower regions of the steel slab, as seen in the cross section of the steel slab in the rolling direction, and due to said assymmetric plastic flow, the grain-oriented silicon steel strip being free from streaks.

2. A process according to claim 1, characterized in that said silicon steel slab contains at least one inhibitor component preferably selected from the group consisting of aluminum, nitrogen, manganese, sulfur, selenium, copper and antimony.

3. A process according to claim 1, characterized in that said hot rolling comprises at least one rough rolling step with a plurality of passes and a finish rolling step with a plurality of passes.

4. A process according to claim 3, characterized in that said asymmetric plastic flow is applied to the steel slab during said rough rolling step.

5. A process according to claim 3, characterized in that said asymmetric plastic flow is applied to the steel slab during said finish rolling step.

6. A process according to claim 1, characterized in that the carbon content of the silicon steel slab is approximately 0.04% by weight.

* * * * *